US005628868A

United States Patent [19]

Marschke et al.

[11] Patent Number: 5,628,868

[45] Date of Patent: May 13, 1997

[54] APPARATUS AND METHOD FOR APPLYING A VISCOUS LIQUID TO A MATERIAL SURFACE

[75] Inventors: Carl R. Marschke; James A. Cummings, both of Phillips, Wis.

[73] Assignee: Marquip, Inc., Phillips, Wis.

[21] Appl. No.: 543,203

[22] Filed: Oct. 13, 1995

[51] Int. Cl.[6] ..... B05C 1/00

[52] U.S. Cl. ..... 156/578; 156/470; 118/261

[58] Field of Search ..... 156/578, 210, 156/470; 118/261, 204, 248

[56] References Cited

U.S. PATENT DOCUMENTS

| | | | |
|---|---|---|---|
| 2,384,676 | 9/1945 | Hill | 156/470 X |
| 2,797,661 | 7/1957 | Leaming . | |
| 3,053,309 | 9/1962 | Wilson et al. . | |
| 3,300,359 | 1/1967 | Nikkel . | |
| 3,671,361 | 6/1972 | Morrison . | |
| 3,972,763 | 8/1976 | Wolvin et al. . | |
| 4,351,264 | 9/1982 | Flaum et al. | 118/261 X |
| 4,357,370 | 11/1982 | Alheid | 118/261 X |
| 4,806,183 | 2/1989 | Williams . | |
| 5,248,362 | 9/1993 | Sissons | 156/578 X |

*Primary Examiner*—James Engel
*Attorney, Agent, or Firm*—Andrus, Sceales, Starke & Sawall

[57] ABSTRACT

An adhesive or other viscous liquid applicator apparatus utilizes a cylindrical glue roll and a reverse acting notched metering or doctor blade which forms, from an initial liquid layer on the roll, a series of laterally spaced liquid beads of metered size. The beads are subsequently spread to form a liquid layer for transfer to a web or other surface moved into generally tangential contact with the roll. The beads are preferably spread by a flexible spreader blade, but may also be spread by operating the peripheral surface of the roll and the web or surface in contact therewith at different speeds. The notched doctor blade provides accurate metering with a mechanically simple apparatus and the formation of beads helps prevent premature drying of the liquid.

20 Claims, 3 Drawing Sheets

10
11
12
13
14
15
16
17
18
20
21
22
23
24
25
26
27
28
29
30
2
3

APPARATUS AND METHOD FOR APPLYING A VISCOUS LIQUID TO A MATERIAL SURFACE

BACKGROUND OF THE INVENTION

The present invention pertains to viscous liquid applying apparatus useful in applying a wide variety of liquid adhesives to web, sheet materials, or other surfaces. The apparatus and related method are particularly useful in the manufacture of corrugated paperboard products.

Roll-type applicators have long been used to apply adhesives to the face of a running web or similar sheet materials. In the manufacture of corrugated paperboard, for example, two or more glue machines are typically used in a corrugator. Each single facer in a corrugator includes a glue machine to apply the adhesive, commonly a starch-based glue, to the flute tips of a corrugated medium web prior to being joined with a liner web in the single facer. Further downstream, a similar glue machine is utilized to apply adhesive to the exposed flute tips on the single face web prior to its joinder with the other liner web in a double backer. Multi-wall board manufacture requires an additional single facer glue machine and a double backer glue machine for each additional single face web.

Roll-type adhesive applicators for single face and double face corrugated webs have typically utilized multi-roll constructions. U.S. Pat. Nos. 3,053,309, 3,671,361 and 4,369,080 are typical of one multi-roll construction in which a glue roll is partially immersed in a reservoir through which it rotates to pick up a layer of glue on its surface, which layer is metered to a desired thickness by engagement with a rotating doctor roll. The glue roll continues to rotate into contact with the flute tips of the corrugated medium. The corrugated medium may either be supported on the toothed roll of corrugator in a single facet or against a backing roll in contact with the liner face of a single face web in a double backer.

Another type of multi-roll glue applicator is shown in U.S. Pat. No. 2,979,661. In this patent a glue roll, operating as previously described, carries the initial glue layer onto the surface of a counterrotating transfer roll which, in turn, carries the transferred layer onto the exposed corrugated medium flute tips. Thus, the glue roll itself also provides the doctor roll function in transferring a metered layer of the glue to the transfer roll. Two-roll metering systems, when handling more viscous materials and traveling at higher speeds, are subject to spreading apart or even bowing as a result of the highly viscous adhesive or other material being forced into the space between the counterrotating rolls. As a result and as speed increases, more adhesive than desired remains on the glue roll and the layer may be very uneven.

U.S. Pat. Nos. 3,300,359 and 4,806,183 show glue or adhesive applicators in which a single glue roll picks up adhesive from a reservoir, is contacted by a smooth-edged doctor blade to meter the amount of adhesive remaining on the roll and transfers the glue to the flute tips of a corrugated medium or single face corrugated web. However, the glue rolls are constructed with a recessed cellular surface forming pockets for the glue, in the manner of an anilox roll used in printing and roll coating. The doctor blades wipe the cylindrical outer surfaces of the rolls to remove essentially all of the adhesive, except for the amounts retained in the cells. Smooth-edged doctor blades are also used to apply a metered layer of adhesive to the surface of a smooth glue roll in a similar manner. All of the foregoing doctor blades are typically forward acting or disposed with the plane of the blade oriented in the direction of roll movement. All of these types of metering systems are subject to a similar problem as that identified with respect to the roll metering systems described above. Again, when applying relatively viscous adhesive materials with a forward running doctor blade, the hydraulic force of the liquid tends to separate the blade from the roll, particularly as speeds increase. As a result, the blade will lift off the roll by a distance greater than desired, resulting in loss of control of the metered layer of adhesive being applied.

U.S. Pat. No. 3,972,763 discloses a glue applicator for either a single facer or a double backer in which a helically grooved glue roll has adhesive applied to the surface thereof by a chambered doctor blade which engages the crest of the helical land, leaving the adhesive in the adjacent helical recess. The adhesive is transferred directly from helically grooved roll to the flute tips of the web. In another disclosed embodiment, the glue roll has a smooth cylindrical surface and the adhesive is applied to the surface of the roll in laterally spaced wavy bead lines created by a roll-contacting oscillating grooved metering roll or notched metering blade. In all embodiments, the helical or beaded pattern of the adhesive on the glue roll is applied directly to the flute tips such that each flute receives laterally spaced dots of adhesive. The dots are spread by subsequent contact with the liner web joined to the fluted medium. The apparatus is adapted particularly to utilize hot melt adhesives in place of conventional starch based adhesives.

The prior art is thus characterized by glue machines which utilize complex multi-roll arrangements, intricate applicator or glue roll surface constructions, or other complex applicator mechanisms. All of the foregoing metering devices are subject to loss of metering control with viscous materials and higher operating speeds. It would be desirable, therefore, to provide a simple but effective assembly for applying a liquid adhesive to a moving web, sheet of material, or other surface.

SUMMARY OF THE INVENTION

In accordance with the present invention, an applicator apparatus for applying a liquid adhesive or other viscous liquid to a moving material surface comprises a supply of adhesive, a cylindrical applicator roll rotatably mounted to bring an outer surface portion into operative communication with the supply adhesive, a metering doctor blade positioned to engage the outer surface of the applicator roll downstream of the adhesive supply, the metering blade being provided with a roll-engaging edge defined by a series of spaced notches separated by straight edge portions, such that the notches form a series of spaced parallel beads of adhesive along the roll outer surface and the edge portions wipe the adhesive from the roll surface between the beads, and means downstream of the metering blade for spreading the adhesive beads laterally across the roll surface and for moving the surface to be coated generally tangentially along and in contact with the roll surface in the direction of rotation to transfer the adhesive to the surface. The metering blade is preferably mounted with the edge oriented in the upstream direction to provide a reverse angle of attack.

Means may also be provided for adjustably mounting the metering blade to vary the angle of attack and thus the size of the beads of adhesive or other viscous liquid. Alternately, bead size may also be varied by utilizing a slide plate to partially close off the notches and thereby vary the depth of the adhesive beads. In one embodiment for coating a web, the means for spreading the adhesive beads and for moving the web comprises means for rotatably driving the roll to provide a given peripheral roll surface speed, and means for pulling the web over the roll surface at a speed greater than the roll surface speed. A similar arrangement may be utilized for applying an adhesive to the surfaces of other objects. In another embodiment, the means for spreading the adhesive beads comprises a continuous-edged spreader blade which is mounted with the edge oriented to engage the applicator roll in the downstream direction to provide a forward-running angle of attack. Preferably, the forward-running doctor blade includes a flexible rubber edge.

When the apparatus is utilized to glue the flute tips of a corrugated paper medium web, the means for moving the web preferably comprises a corrugating roll of a single facer. When the apparatus is utilized to apply the adhesive to the flute tips of the corrugated medium of a single face web, the means for moving the web preferably comprises a downstream double backer web drive.

The basic method of the present invention may be utilized to apply a viscous liquid to a material surface and comprises the steps of mounting a rotatable cylindrical applicator roll with an outer surface portion thereof in contact with a supply of the viscous liquid, positioning a metering doctor blade to engage the outer surface of the applicator roll downstream of the liquid supply, providing said metering blade with a roll-engaging edge defined by a series of spaced notches separated by straight edge portions, orienting the metering blade with the edge positioned to provide a reverse angle of attack with respect to the roll surface, rotating the roll to form a series of spaced parallel beads of liquid along the outer roll surface and to wipe essentially all of the liquid from the roll surface between the beads, and spreading the liquid beads laterally across the roll surface and moving the material surface generally tangentially along and in contact with the roll surface in the direction of rotation to transfer the liquid to the surface.

In accordance with one embodiment of the method of the present invention, a liquid adhesive is applied to the flute tips of a corrugated paper web by the steps of applying a continuous layer of adhesive to the surface of a rotating cylindrical applicator roll, mounting a metering doctor blade with a blade edge in contact with the adhesive coated surface of the roll, providing the blade edge with spaced notches separated by straight edge portions to create spaced parallel beads of adhesive separated by annular roll surface portions with essentially no adhesive thereon, mounting a spreader blade with a continuous blade edge in contact with the bead-carrying roller surface downstream of the metering blade to spread the adhesive beads into a layer of selected thickness, and moving the web to bring the corrugated flute tips into generally tangential contact with the roller surface to transfer the adhesive to the flute tips.

In one embodiment, the corrugated web comprises a medium for a single face web and the step of moving the web comprises carrying the web on the peripheral surface of a grooved corrugating roll. In another embodiment, the web comprises a single face web and the step of moving the web comprises pulling the single face web and a subsequently attached liner web through a downstream double backer.

Preferably, the step of mounting the metering doctor blade includes orienting the blade to extend in the upstream direction to provide a reverse angle of attack. The method may also include the step of adjusting the angle of attack of the metering blade or otherwise changing the size of the notches with respect to the roll surface to vary the size of the adhesive beads.

DETAILED DESCRIPTION OF THE PREFERRED EMBODIMENTS

Figures 1, 2, 3:
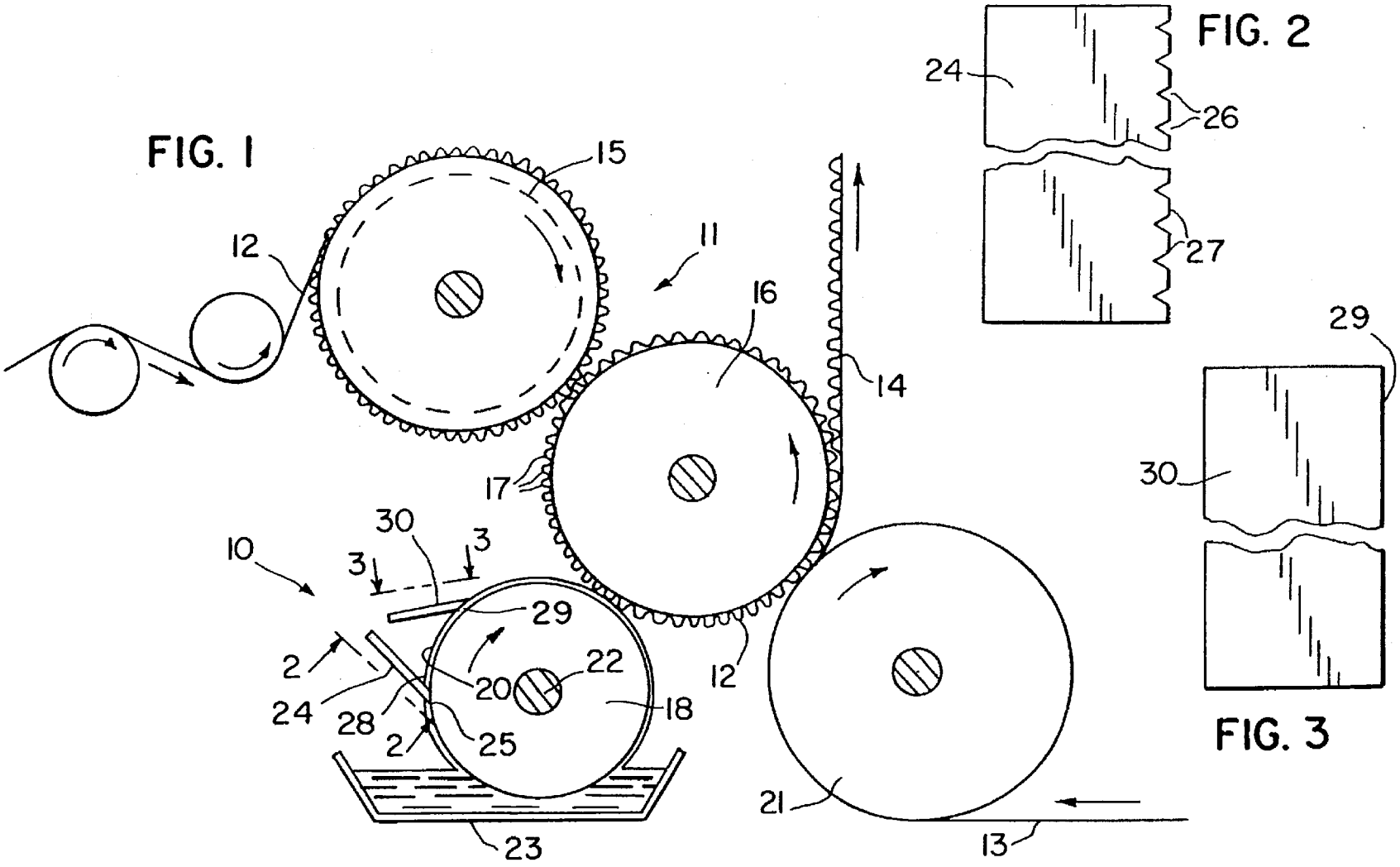
FIG. 1 is a side elevation view of an adhesive applicator apparatus of the present invention as applied to a single racer for corrugated paperboard.
FIG. 2 is an enlarged view of the metering blade taken on line 2—2 of FIG. 1.
FIG. 3 is an enlarged view of the spreader blade taken on line 3—3 of FIG. 1.

Referring initially to FIGS. 1–3, an adhesive applicator apparatus 10, constructed in accordance with one embodiment of the present invention, is shown in operative association with a corrugator single facet 11. In the single facer, a corrugated medium web 12 is adhesively joined to a liner web 13 to form a single face web 14. The applicator apparatus 10 of the present invention is used to apply a liquid adhesive, such as a conventional starch based glue commonly use in the manufacture of corrugated paperboard, to the corrugated flute tips of the medium web 12. However, all of the various embodiments of the apparatus and method of the present invention, disclosed herein, may include the use of a wide range of other types of adhesives, such as PVA-based adhesives, as well as other viscous liquids.

The medium web 12 is corrugated by passing it between counterrotating first and second corrugating rolls 15 and 16 and, as the corrugated web moves over the surface of the second corrugating roll 16, a line of adhesive is applied to each flute tip 17 by transfer from the cylindrical outer surface 20 of a glue roll 18. The corrugated medium 12 continues to travel along a portion of the periphery of the second corrugating roll 16 where it is joined with the liner web 13 in a nip formed by the roll 16 and a counterrotating pressure roll 21.

The glue roll 18 may be of generally conventional construction and mounted to rotate on its axis 21 so that the lower portion of the roll surface travels through a glue pan 23 where an initial layer of glue is picked up and adheres to the roll surface 20. Just above the glue pan in the direction of roll rotation, a metering doctor blade 24 is mounted in operative contact with the roll surface 20. The doctor blade 24 is preferably mounted to orient the blade edge in the upstream direction so as to position the blade against the roll to provide a reverse angle of attack or contact. As is shown in FIG. 2, the roll-engaging edge 25 of the doctor blade 24 includes a series of spaced notches 26 which are separated by straight edge portions 27. As the initial layer of glue, picked up by the roll surface passing through the glue pan 23, contacts the metering blade edge 25, the notches 26 cause the formation of a series of spaced, generally parallel glue beads 28 along the outer surface 20 of the roll 18, while the straight edge portions 27 wipe the glue from the roll surface 20 between the beads.

The size and/or spacing of the notches 26 is selected to provide a metered volume of glue sufficient to assure an adequate laterally continuous glue line is applied to each flute tip 17 of the corrugated medium 12 so that a continuous bond line will be provided with the surface of the liner web 13 where the two are joined in the nip between the second corrugating roll 16 and the pressure roll 21.

The glue beads 28 formed by the notched metering blade 24, in addition to providing precise volumes of glue for the particular flute size being run, also provides the advantage of preventing premature drying of the glue layer on the glue roll 18. If a metered layer of glue remains on the glue roll over a significant portion of the glue roll surface 20, it may lose too much moisture before the glue roll actually contacts and transfers the glue to the flute tips. However, by forming the metered volume of glue initially in beads 28, moisture loss and premature drying are substantially reduced.

Further downstream and just before the transfer nip between the glue roll 18 and the web on the second corrugating roll 16, the glue beads are spread to form a uniform glue layer on the surface of the glue roll by a forward operating spreader blade 30. The blade has a simple straight edge 29 blade as shown in FIG. 3. The beads 28 on the surface of the rotating glue roll 18 are spread to a uniform layer by contact of the spreader blade edge. The blade edge may be relatively rigid and maintained slightly spaced from the surface of the glue roll so that substantially all of the volume of glue in the beads is utilized to form the final thin layer. The uniform layer is transferred in the form of a continuous glue line to each flute tip 17 which comes in contact therewith by rotation of the corrugating roll 16. Unused glue which remains on the surface of the glue roll, namely the portion of the glue layer which spans the flute tips and is not transferred to the corrugated web 12, is returned to the glue pan 23.

Figure 8:
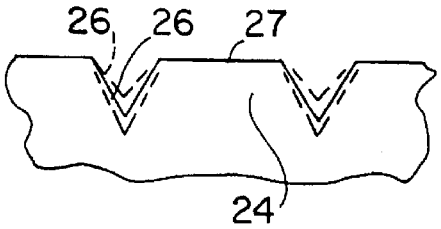
FIG. 8 is an enlarged detail of the edge of the blade shown in FIG. 2.
Figure 8A:
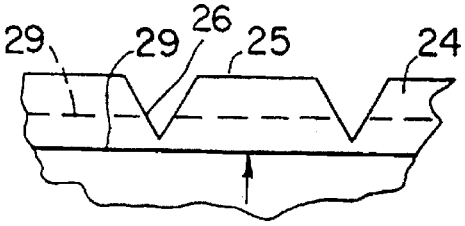
FIG. 8A is an enlarged detail of an alternate embodiment of a bead size adjustment device.

As indicated previously, the total volume of glue in the bead lines 28 can be varied by varying the number of notches 26 in the blade 24 and/or by changing the size of the notches. By mounting the metering blade 24 in a manner in which its angle of attack with respect to the cylindrical surface 20 of the roll may be varied, the height of the notches, and therefore the size of the glue beads formed, may also be varied. This is shown schematically in FIG. 8 where dotted line outlines of the notches show how they may be made effectively smaller or larger than the solid line positions by varying the blade angle with respect to the roll surface. Alternately, the metering blade 24 may be constructed of a flexible rubber-like material and the height of the notches varied simply by increasing or decreasing the force by which the blade edge is held against the roll surface and thus the degree of bend or curvature imparted to the blade edge. FIG. 8A shows a further embodiment of a means for adjusting the effective size of the notches 26 and, therefore, the size of the beads of the adhesive or other viscous liquid being processed. A slide plate 29 is mounted against one face of the metering blade 24 for adjustable movement toward and away from the blade edge 25. If the slide plate 29 is moved in the direction of the arrow to the dotted line position, such that it covers portions of the notches 26, their effective size is decreased and thus the size of the glue beads are likewise decreased.

It has also been found that the spreader blade 30 is preferably made of a relatively flexible rubber material. In this case, instead of maintaining the spreader blade edge at a fixed distance from the roll surface to spread the beads into a uniform layer, as would be done with the rigid blade, the flexible spreader blade edge is allowed to ride resiliently against the glue roll surface 20.

Figure 4:
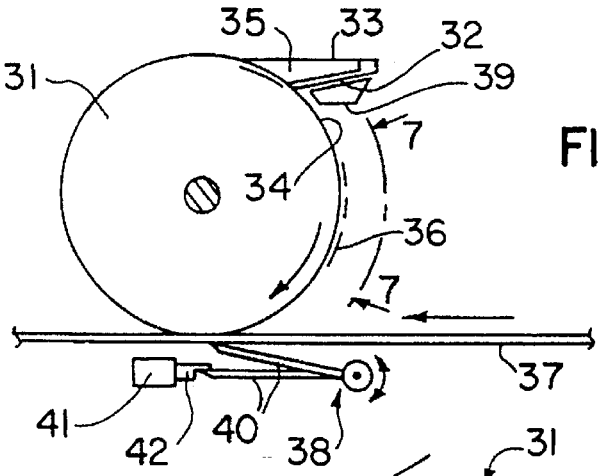
FIG. 4 is a side elevation of an alternate embodiment of the apparatus of the present invention.
Figure 5:
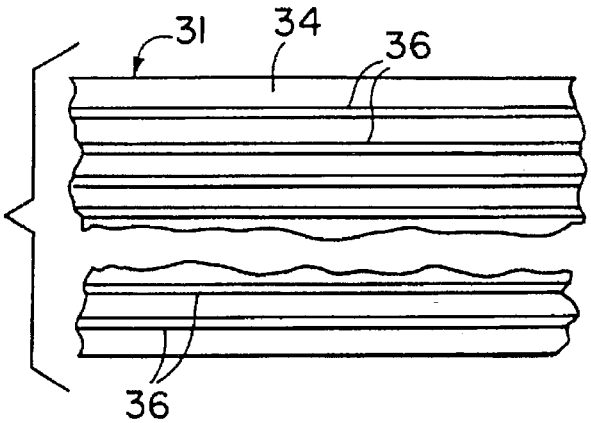
FIG. 5 is an enlarged detail taken on line 5—5 of FIG. 4.

In FIG. 4, there is shown an embodiment of the invention in which a glue roll 31 is used to apply a continuous uniform glue layer to the surface of a plain paper web or discrete plain paper sheets. In this embodiment, the notched metering blade 32 functions as a chambered doctor blade, namely by forming one wall of a glue reservoir 33. The glue is thus dammed against outer surface 34 of the glue roll 31 and retained between laterally opposite end walls 35. The metering blade 32 is positioned at a reverse angle with respect to the roll surface, as in the previous embodiment, and rotation of the glue roll 31 counter to the blade angle as shown results in the formation of a series of parallel spaced glue beads 36 as shown in detail in FIG. 5.

A running web 37 is supported to travel below the glue roll 31 and normally out of contact with the glue beads 36 on the surface thereof. The web is preferably run at a significant overspeed, such as 30%, with respect to the peripheral surface speed of the glue roll 31. In certain applications, longitudinal portions of a traveling web 37, or similar longitudinal portions of discrete sheets moving through the glue apparatus in a manner similar to the web, do not have glue layers applied. When it is desired to commence application of the glue layer, a lower web lifting apparatus 38 is activated to raise the web 37 into contact with the glue beads 36 on the surface of the glue roll 31. The combination of web contact with the glue beads and web overspeed with respect to the peripheral speed of the glue roll results in a uniform spreading of the beads to form the desired continuous glue layer on the upper face of the web. Alternately, the speed differential may be provided by running the roll 31 at an overspeed with respect to the web speed.

The web lifting apparatus 38 preferably comprises a number of individual laterally adjoining spring fingers 40 extending across the full width of the glue roll 31. Each of the fingers includes an electromechanical actuator 41, such as a solenoid operated positioning device, operative to normally hold each of the spring fingers 40 in the lower non-contact position against the bias of the spring material. When the solenoid is actuated to retract a movable stop 42, the finger 40 moves upwardly under its inherent spring force or other biasing mechanism to press the web upwardly against the glue roll.

By utilizing segmented spring fingers extending across the full width of the glue roll 31, only those fingers 40 defining the lateral width of the web 37 being processed are activated, leaving the outboard spring fingers in their retracted positions. In this manner, the unused fingers remain out of contact with the surface of the glue roll and any adhesive beads or coating thereon. Any glue remaining on the glue roll after transferring contact with the moving web 37 may be returned to the reservoir 33.

Figure 6:
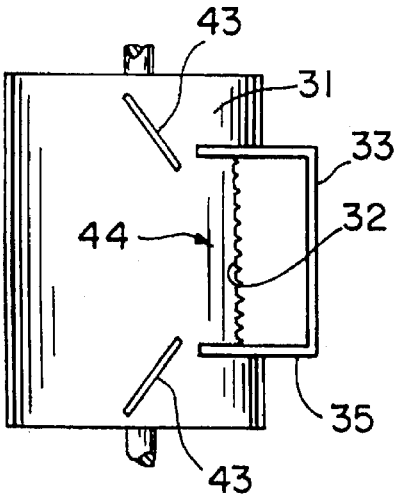
FIG. 6 is a top plan view of the apparatus shown in FIG. 4.

Referring also to FIG. 6, to assure that any adhesive or other liquid remaining on the surface of the roll 31, after contact with the web 37, is returned to the glue reservoir 33, a pair of deflector blades 43 may be mounted near the top of the roll and in contact with the surface 34 thereof. The deflector blades are mounted at an angle, as shown, to effectively plow any remaining liquid material toward the center of the roll 31 and into the path of the opening 44 to the glue reservoir to return the liquid directly to the reservoir.

Certain types of viscous liquids, for example PVA adhesives, have a tendency to build up on the backside of the notched metering blade 32 and, as the adhesive material dries, it forms stalactites. As the size of the buildup grows, portions of the dried or partly dried stalactites may break off and fall onto the web 37 or the outer surface 34 of the glue roll. To prevent the formation of such an adhesive buildup, a humidifying chamber 39 may be attached to the backside of the metering blade 32 with its radially inner surface spaced from the surface of the roll sufficiently so as not to interfere with the glue beads 36 formed thereon. The chamber is provided with a high humidity, for example with a water or solvent spray, to keep the surface wetted and prevent the formation of detrimental adhesive buildups.

Figure 7:
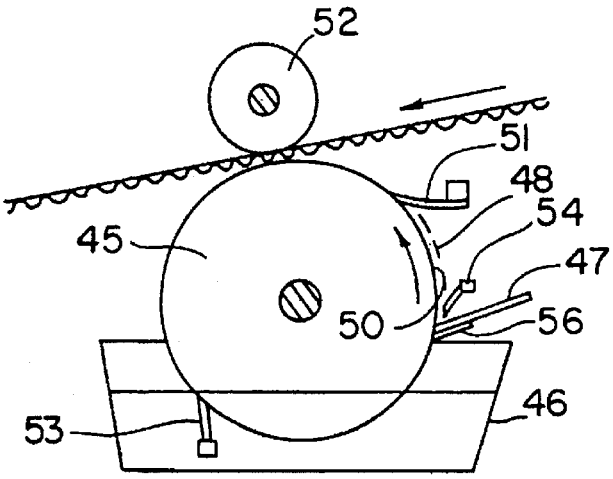
FIG. 7 Is a side elevation of another embodiment of the apparatus of the present invention.
Figure 9:
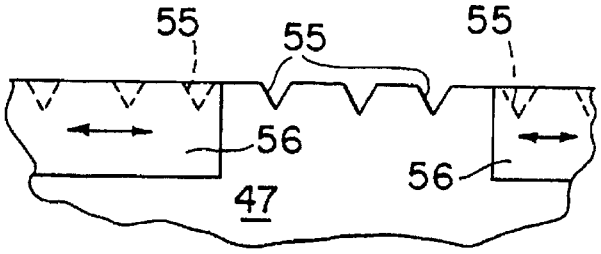
FIG. 9 is an enlarged detail of the metering blade in the FIG. 8 embodiment.

Another embodiment of the adhesive applicator apparatus 10 is shown in FIGS. 7 and 9. The apparatus is shown specifically for gluing the flute tips of a single face web 14, for example, just prior to applying the liner to form a double face web in a double backer. In this embodiment, a glue roll 45 is rotatably supported above a glue pan 46, as in the FIG. 1 embodiment, so that the lower portion of the roll rotates into and picks up glue from the pan. A reverse acting doctor blade 47, notched in the same manner as metering blades 24 and 32, is positioned to form glue beads on the roll surface 50, which beads are subsequently spread to form a continuous layer by contact with the downstream flexible spreader blade 51. The single face web 14 is moved generally tangentially over the glue roll 45 where the flute tips 17 contact and pick up laterally extending lines of adhesive from the layer on the roll surface 50. A backing roll 52 is preferably positioned against the liner side of the web 12 in a position set to accommodate the thickness of the web and the amount of glue to be transferred from the roll to the flute tips 17. Glue which is not transferred to the web and remains on the roll surface 50 may be scraped therefrom by a reverse acting scraper blade 53 so that fresh glue is applied to the surface of the roll as it enters the reservoir or glue pan 46. The scraper blade 53 may be submerged in the liquid glue, as shown, so the glue is returned directly to the supply in the pan.

It may be desirable to mount a recirculating wiper 54 above the metering blade 47 to periodically clean glue which may accumulate on the downstream face of the metering blade adjacent the notches 55. Referring also to FIG. 9, it may also be desirable to provide means for selectively closing the notches 55 in varying numbers inwardly from each lateral edge so that glue beads 48 are formed only across the width of the single face web 14. In this manner, glue beads will not be applied to the roll surface nor contacted or spread by the spreader blade 51 where there is no single face web to which glue will be transferred. The back side or upstream face of the metering blade 47 has a pair of laterally slidable adjustment blades 56 attached to either end. The adjustment blades 56 have straight continuous edges and may be selectively positioned to close off notches 55 which lie outside the width of the web being processed.

Figure 10:
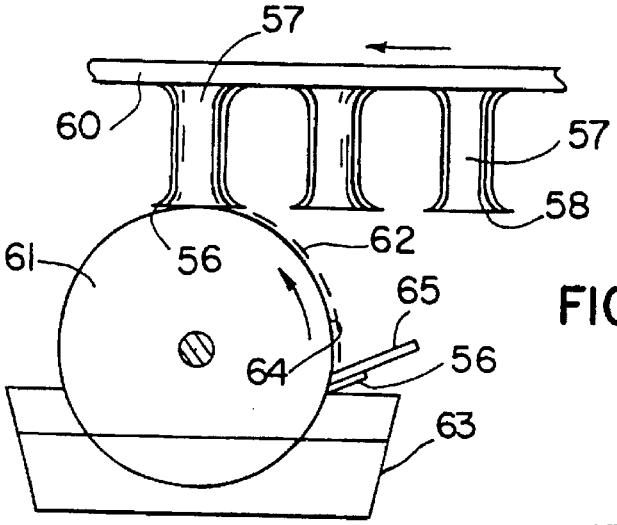
FIG. 10 is a side elevation of a further embodiment of the invention similar to the apparatus shown in FIG. 7.

In FIG. 10, there is shown an embodiment of the invention in which the apparatus of FIG. 7 has been modified to apply an adhesive coating to the generally flat surfaces of discrete articles, rather than a continuous running web. In the example shown, paper spools 57 having generally flat flanged end faces 58 are supported to depend downwardly from a traveling carriage 60 which moves the spools over the top surface of the glue roll 61 to bring the lower end faces 58 into sequential tangent contact with the adhesive on the surface of the glue roll. In this embodiment, the glue roll passes through a glue pan 63 and the glue picked up on the outer roll surface 64 travels past a reverse acting metering blade 65, which may be basically the same as the blade 47 in the FIG. 7 embodiment, to form the glue beads 62. However, in this embodiment, a separate spreading blade has been eliminated and the glue beads 62 are applied directly to the end faces 58 of the spools. The glue beads are spread upon contact and, to enhance the spreading of the glue, a speed differential may be provided between the linear speed of the carriage 60 and the peripheral speed of the glue roll 61, as described with respect to previous embodiments.

Figure 11:
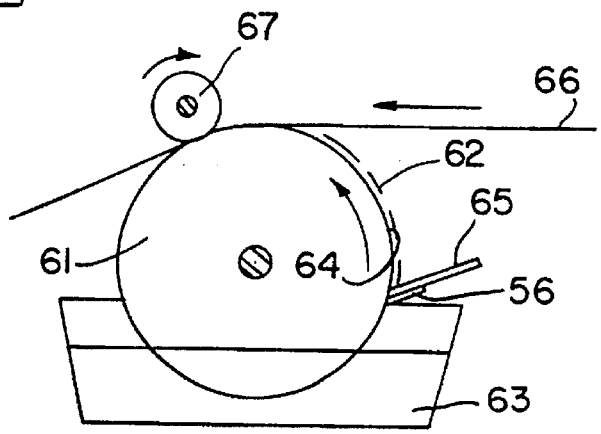
FIG. 11 is yet another embodiment of the apparatus, similar to that of FIG. 10, but adapted to process a running web.

Referring to FIG. 11, the apparatus of the FIG. 10 embodiment is shown modified to apply glue to the face of a paper web 66. The web 66 is preferably pulled over the glue roll 61 at a speed slightly in excess of the peripheral speed of the outer surface 64 of the glue roll 61. As shown, the web 66 enters in a generally horizontal upstream run and, after tangent contact with the glue roll and glue beads 62 thereon, is wrapped in a downstream direction against the glue roll over a relatively small arc of rotation, for example, about 20°. The wrapped portion of the web 66 is maintained by a downstream backing roll 67. The glue beads 62 which are squeezed and flattened by initial web contact, are spread uniformly by the additional contact and the differential speeds between the roll and the web.

The use of the reverse acting notched doctor blade in all of the foregoing embodiments provides a number of distinct benefits over prior art metering apparatus. The reverse acting doctor blade is insensitive to the hydraulic pressure of the viscous liquid coating on the roll and to increases in roll speed. Thus, the metered size of the beads of adhesive or other viscous liquid remain consistent regardless of variations in glue roll speed. The glue beads have relatively small surface areas as compared to the surface area of the same volume of glue spread to a thin coating. As a result, solvent loss and consequent premature drying of the adhesive is far less in the beaded configuration. As described with respect to the various embodiments, once a metered amount of adhesive has been accurately provided by the notched doctor blade, the adhesive may be spread onto the roll or onto the surface of the article being coated in a variety of different ways.

We claim:

1. An adhesive applicator apparatus for applying a viscous liquid to a moving material surface comprising:

a liquid supply;

a cylindrical applicator roll rotatably mounted with an outer surface portion in operative communication with the supply to pick up liquid therefrom;

a metering doctor blade positioned to engage the outer surface of the applicator roll downstream of the liquid supply with respect to the direction of roll rotation, said metering blade having a roll-engaging edge defined by a series of spaced notches separated by straight edge portions;

means for mounting said metering blade to orient the edge in the upstream direction to provide a reverse angle of attack;

said notches adapted to form a series of spaced parallel beads of liquid along the roll outer surface and said edge portions adapted to substantially wipe the liquid from the roll surface between the beads; and, means downstream of said metering blade for spreading said liquid beads laterally across the roll surface and for moving the surface of the material generally tangentially along and in contact with the roll surface in the direction of rotation to transfer the liquid to the surface.

2. The apparatus as set forth in claim 1 including means for adjusting said metering blade to vary the size of the beads of adhesive.

3. The apparatus as set forth in claim 1 wherein said means for spreading the liquid beads and for moving the material comprises:

means for rotatably driving the roll to provide a given peripheral roll surface speed; and, means for moving the material over the roll surface at speed different than the roll surface speed.

4. The apparatus as set forth in claim 1 wherein said means for spreading the liquid beads comprises a continuous-edged flexible spreader blade mounted with the edge oriented to engage the applicator roll in the downstream direction to provide a forward-running angle of attack.

5. The apparatus as set forth in claim 1 including humidifying means for preventing the drying of the liquid and build up thereof on the downstream face of the metering blade.

6. A method for applying a viscous liquid to a material surface comprising the steps of:

(1) applying a continuous layer of the liquid to the surface of a rotating cylindrical applicator roll;

(2) mounting a metering doctor blade with a blade edge in contact with the liquid layered surface of the roll;

(3) orienting the blade edge to extend in the upstream direction and provide a reverse angle of attack with respect to the applicator roll;

(4) providing the blade edge with spaced notches separated by straight edge portions to create spaced parallel beads of the liquid separated by annular roll surface portions with essentially no liquid thereon;

(5) mounting a spreader blade with a continuous blade edge in contact with the bead-carrying roll surface downstream of said metering blade to spread the liquid beads into a layer of selected thickness; and, (6) moving the material to bring the material surface into generally tangential contact with the roller surface to transfer the liquid to said surface.

7. A method for applying a viscous liquid to a moving material surface comprising the steps of:

(1) providing a liquid supply;

(2) mounting a rotatable cylindrical applicator roll with an outer surface portion in operative communication with the supply to pick up the liquid;

(3) positioning a metering doctor blade to engage the outer surface of the applicator roll downstream of the liquid supply with respect to the direction of roll rotation;

(4) providing said metering blade with a roll-engaging edge defined by a series of spaced notches separated by straight edge portions;

(5) orienting said metering blade with the edge in the upstream direction to provide a reverse angle of attack;

(6) rotating said roll to form a series of spaced parallel beads of liquid along the roll outer surface and to wipe essentially all of the liquid from the roll surface between the beads; and, (7) spreading said liquid beads laterally across the roll surface and moving the material surface generally tangentially along and in contact with the roll surface in the direction of rotation to transfer the liquid to the surface.

8. An adhesive applicator apparatus for applying a liquid adhesive to a moving web comprising:

an adhesive supply;

a cylindrical applicator roll rotatably mounted with an outer surface portion in operative communication with the supply to pick up liquid adhesive;

a metering doctor blade positioned to engage the outer surface of the applicator roll downstream of the adhesive supply with respect to the direction of roll rotation, said metering blade having a roll-engaging edge defined by a series of spaced notches separated by straight edge portions, said notches adapted to form a series of spaced parallel beads of adhesive along the roll outer surface and said edge portions adapted to wipe the adhesive from the roll surface between the beads; and, means downstream of said metering blade for spreading said adhesive beads laterally across the roll surface and for moving the web generally tangentially along and in contact with the roll surface in the direction of rotation to transfer the spread adhesive to the web.

9. The apparatus as set forth in claim 8 wherein said metering blade is mounted with the edge oriented in the upstream direction to provide a reverse angle of attack.

10. The apparatus as set forth in claim 9 including means for adjustably mounting said metering blade to vary the angle of attack and the size of the beads of adhesive.

11. The apparatus as set forth in claim 8 wherein said means for spreading the adhesive beads and for moving the web comprises:

means for rotatably driving the roll to provide a given peripheral roll surface speed; and, means for pulling the web over the roll surface at speed different than the roll surface speed.

12. The apparatus as set forth in claim 8 wherein said means for spreading the adhesive beads comprises a continuous-edged spreader blade mounted with the edge oriented to engage the applicator roll in the downstream direction to provide a forward-running angle of attack.

13. The apparatus as set forth in claim 12 wherein said forward running spreader blade includes a flexible rubber edge.

14. The apparatus as set forth in claim 12 wherein the web comprises a corrugated paper medium web and said means for moving the web comprises a corrugating roll of a single facer.

15. The apparatus as set forth in claim 12 wherein the web comprises a single face corrugated paper web oriented to cause the corrugated medium to contact the roll surface and said means for moving the web comprises a double backer web drive.

16. A method for applying a liquid adhesive to the flute tips of a corrugated paper web comprising the steps of:

(1) applying a continuous layer of the adhesive to the surface of a rotating cylindrical applicator roll;

(2) mounting a metering doctor blade with a blade edge in contact with the adhesive layered surface of the roll;

(3) providing the blade edge with spaced notches separated by straight edge portions to create spaced parallel beads of adhesive separated by annular roll surface portions with essentially no adhesive thereon;

(4) mounting a spreader blade with a continuous blade edge in contact with the bead-carrying roll surface downstream of said metering blade to spread the adhesive beads into a layer of selected thickness; and, (5) moving the web to bring the corrugated flute tips into generally tangential contact with the roller surface to transfer the adhesive to said flute tips.

17. The method as set forth in claim 16 wherein said corrugated web comprises the medium for a single face web and the step of moving the web comprises carrying said web on the peripheral surface of a grooved corrugating roll.

18. The method as set forth in claim 16 wherein said web comprises a single face web and the step of moving the web comprises pulling the single face web and a liner web attached to said flute tips through a downstream double backer.

19. The method as set forth in claim 16 including the step of mounting said metering doctor blade to orient the blade edge to extend in the upstream direction and provide a reverse angle of attack with respect to the applicator roll.

20. The method as set forth in claim 19 including the step of adjusting the angle of attack of said blade edge with respect to the roll surface to vary the size of the adhesive beads.

* * * * *